US005509981A

United States Patent [19]

Dean

[11] Patent Number: 5,509,981

[45] Date of Patent: Apr. 23, 1996

[54] HYBRID ROCKET FUEL

[75] Inventor: David L. Dean, New Market, Ala.

[73] Assignee: McDonnell Douglas Corporation

[21] Appl. No.: 198,350

[22] Filed: Feb. 18, 1994

[51] Int. Cl.[6] ..... C06B 45/10

[52] U.S. Cl. ..... 149/19.4; 149/19.1; 149/19.5; 149/19.6; 149/19.9

[58] Field of Search ..... 149/19.4, 19.1, 149/19.5, 19.6, 19.9, 19.8, 19

[56] References Cited

U.S. PATENT DOCUMENTS

| | | | |
|---|---|---|---|
| 3,132,976 | 5/1964 | Klager et al. | 149/19 |
| 3,296,043 | 1/1967 | Fluke et al. | 149/19 |
| 4,078,954 | 3/1978 | Bernardy | 149/19.8 |
| 4,206,006 | 6/1980 | Ratz | 149/19.9 |
| 4,343,663 | 8/1982 | Breza et al. | 149/4 |
| 4,600,451 | 7/1986 | Jessop et al. | 149/19.3 |
| 4,670,068 | 6/1987 | Chi | 149/19.4 |
| 4,937,340 | 6/1990 | Huang et al. | 544/194 |

*Primary Examiner*—Donald P. Walsh
*Assistant Examiner*—John R. Hardee
*Attorney, Agent, or Firm*—Ronald L. Taylor

[57] ABSTRACT

A solid rocket fuel formed by mixing a liquid hydroxyl terminated prepolymer such as polybutadiene, with hexamethylenetetramine, and adding a cross-linking agent, particularly a multifunctional isocyanate. The mixture is poured or cast into a mold, cartrige, or insulated motor case and cured, preferably at ambient temperature. The hexamethylenetetramine is employed as the major fuel component in an amount in the range of about 60 to about 83% based on the total weight of the fuel. The preferred curing or cross-linking agent is a liquid multifunctional isocyanate. Processing aids and/or mechanical property modifiers can be added in minor amounts.

34 Claims, No Drawings

HYBRID ROCKET FUEL

BACKGROUND OF THE INVENTION

This invention relates to an improved hybrid rocket fuel, and is particularly directed to a hybrid rocket fuel containing a high percentage of hexamethylenetetramine, and to its method of production.

Hybrid fuel systems for rocket propulsion are those in which 1) the fuel and oxidizer are stored separately, and 2) either the fuel or the oxidizer is a solid, while the other component is a liquid. Hybrids appear to have advantages over both solid and liquid propulsion systems in cost, safety, reliability and in producing environmentally benign combustion products. However, a major limitation in development of hybrid rocket propulsion has been the solid fuel regression rate. The regression rate is the rate at which the surface erodes, that is, the rate at which molecules at the surface (often high molecular weight molecules) are decomposed into smaller fragments and/or vaporized, so they can subsequently be burned. It is desirable to obtain as high a regression rate as possible.

U.S. Pat. No. 4,206,006 to Ratz teaches that hexamethylenetetramine as well as nitrited products thereof, can be used as an ignition catalyst in hybrid rocket fuels to increase the reaction speed with respect to the oxidation medium. The patent discloses that hexamethylenetetramine can be used as a catalyst in a proportion of about 5% to 50% based on the total mass of the fuel "to vary within wide limits the speed of reaction with the oxidizer". The hexamethylenetetramine in Ratz is added to the fuel which is in the form of a liquid prepolymer of butadiene with terminal carboxyl groups and a trifunctional cross-linking agent such as phosphoric acid tripropyleneimide.

It is an object of the invention to provide an improved hybrid fuel for rocket propulsion.

Another object is the provision of a hybrid rocket fuel containing hexamethylenetetramine and an elastomeric binder system, e.g. polybutadiene, polyether, or polyester, crosslinked via polyurethane linkages, wherein the hexamethylenetetramine functions as the major fuel component.

Yet another object is to provide an improved hybrid rocket fuel of the above type employing a superior elastomeric binder system, differing both in prepolymer and cross-linking agent from that of the above Ratz patent, and exhibiting improved moisture resistance and superior aging characteristics compared to that of Ratz.

Still another object is the provision of a hybrid rocket fuel containing hexamethylenetetramine as the major fuel component and having improved regression rate and improved motor performance.

A further object is to provide a method for producing the improved hybrid fuel for rocket propulsion of the invention.

Other objects and advantages will appear hereinafter.

SUMMARY OF THE INVENTION

According to the invention there is provided a new improved hybrid solid fuel comprising primarily hexamethylenetetramine held together by an advanced elastomeric binder system. In contrast to the hybrid rocket fuel of the above Ratz patent, the hybrid rocket fuel of the present invention comprises about 60 to about 83% hexamethylenetetramine based on the total weight of the fuel, and is the major component of the fuel, rather than a catalyst.

The rocket fuel of the invention utilizes a liquid prepolymer of butadiene having terminal hydroxyl groups as binder, cured by a cross-linking agent, particularly an isocyanate of functionality equal to or greater than two. Thus the binder system is held together by hydrolytically stable polyurethane bonds (reaction product of hydroxyl and isocyanate) in contrast to that of the Ratz patent which employed less hydrolytically stable phosphoramide bonds.

The rocket fuel of the invention is designed to be oxidized by oxygen, but can be oxidized by other known oxidizers such as dinitrogen tetroxide or dinitrogen pentoxide, nitric acid, or hydrogen peroxide. This fuel exhibits a regression rate substantially higher than those of either straight polybutadiene, hydrocarbon filled polybutadiene, or hexamethylenetetramine filled polybutadiene when the filler content is less that 50%, such as the formulations of Ratz. In the invention described herein, hexamethylenetetramine is the fuel itself, not a catalyst. Low regression rates force motor design to be long and slender, since the requirement for the fuel to be completely burned in a given amount of time, forces the fuel thickness (the distance between the hollow core and the walls) to be relatively small. The increased regression rate of the fuel of the invention allows the fuel thickness to be increased in the motor, simultaneously allowing the motor to be shortened, and decreasing the surface area and weight of the motor case. The decreased motor case weight enabled by the higher regression rate fuel of the invention results in increased motor performance.

The solid fuel composition of the invention achieves good mechanical properties over a wide range of temperatures via use of an advanced elastomeric binder system which employs hydroxyl terminated prepolymers (e.g. polybutadiene, polyether or polyester) cured with an isocyanate to form polyurethane crosslinks. The process to make the fuel can be carried out entirely at ambient temperatures, an improvement over the Ratz process which utilizes an energy intensive, potentially hazardous operation requiring cure temperatures above the boiling point of water.

The fuel composition of the invention containing at least 60% and preferably of the order of about 83% by weight hexamethylenetetramine, requires significantly less oxygen for combustion than a hydrocarbon composition producing a similar specific impulse. The density of the invention fuel is also greater than other known hybrid fuels. These two characteristics combine to reduce the size of a motor required to achieve a given amount of thrust, and increase the motor's performance. The fuel composition of the invention containing the above noted major proportion of hexamethylenetetramine in an elastomeric binder as noted above, exhibits a regression rate significantly higher than any other known hybrid fuel composition, and can exceed the highest possible rate obtainable via the Ratz approach (at 50% hexamethylenetetramine content) by up to about 30 percent.

Further, the fuel composition of the invention burns at a lower temperature, produces no solid particulates, (while achieving comparable specific impulse), and produces lower amounts of water than compositions containing greater amounts of hydrocarbons.; is environmentally benign, producing only water, $CO_2$, $N_2$ and CO as primary combustion products; is characterized by smoother combustion than straight hydroxyl terminated polybutadiene systems; is stoppable, restartable, and throttleable over a wide range of O/F (oxygen to fuel) ratios while maintaining a high combustion efficiency; is inherently safer in handling, storing and firing operations; and processing of the fuel of the invention, containing at least 60%, and preferably about 83%, by weight hexamethylenetetramine in isocyanate cured hydroxyl terminated prepolymer; requires no heating during mixing and cures at ambient temperature to a solid fuel which exhibits good mechanical properties and superior aging characteristics.

According to the invention for producing the hybrid fuel hereof, hexamethylenetetramine is added to the hydroxyl terminated liquid prepolymer and mixed together. The solution is degassed under vacuum, if necessary, to remove water. The curing or cross-linking isocyanate is added and the resulting mixture is poured into a mold to be shaped and cured. The amount of hexamethylenetetramine used is in the range of about 60% to about 83% by weight of the total fuel mass. The mixture cures at room temperature in a few hours. A moderately elevated temperature, such as 50° C., can be used to accelerate the cure reaction.

The solid fuel thus produced can be oxidized by oxidizers such as oxygen, hydrogen peroxide, or oxides of nitrogen.

DETAILED DESCRIPTION OF THE INVENTION AND PREFERRED EMBODIMENTS

As previously noted, the invention provides a fuel substance for hybrid rocket propulsion in the form of a shaped mass of a material containing from about 60% to about 83% by weight hexamethylenetetramine in an elastomeric binder system. The rocket fuel is produced by first adding hexamethylenetetramine to a liquid hydroxyl terminated prepolymer, such as polybutadiene, polyether or polyester. Commercially available liquid, hydroxyl terminated polybutadienes have average molecular weights ranging between 1230 and 2800 with average functionalities of 2.5. Commercially available hydroxyl terminated polyethers have average molecular weights ranging from 250 to 7300, with functionalities ranging from 2 to 4. Commercially available hydroxyl terminated polyesters have average molecular weights ranging from about 750 to about 4000 with functionalities of 2. All are low to medium viscosity liquids. The preferred liquid polybutadiene prepolymer of this type has a molecular weight of about 2800 and a functionality of 2.5. The preferred liquid polyether prepolymer is a combination of three prepolymers ranging in molecular weight from 250 to 7300, and ranging in functionality from 2 to 4. One polyether prepolymer has a molecular weight of about 3900 and a functionality of 2, the second has a molecular weight of about 4900 and a functionality of about 3, while the third has a molecular weight of 250 and a functionality of 3. The amount of the hexamethylenetetramine is about 1.5 to about 4.88 times the weight of the binder, such that the final cured rocket fuel has a range of hexamethylenetetramine from about 60 to about 83% by weight of the fuel. If an amount of hexamethylenetetramine is used above 83% by weight of the fuel, insufficient bonding of the hexamethylenetetramine results. An amount of hexamethylenetetramine below 60% by weight of the fuel fails to produce the desired high regression and burning rate of the rocket fuel of the invention. A preferred range is about 70 to about 83% hexamethylenetetramine by weight of the fuel.

The hardening of the liquid prepolymer is accomplished by adding to the mixture of hexamethylenetetramine and liquid hydroxyl terminated prepolymer, a curing agent. The curing or cross-linking agent is preferably an isocyanate, particularly a multifunctional isocyanate, e.g. a diisocyanate such as an aliphatic or aromatic diisocyanate. Examples of high functionality curatives are polymethylene polyphenyl isocyanate with a molecular weight ranging from about 290 to about 375, e.g. 340, and a functionality of about 2.3 to about 3.0, or oligomeric hexamethylene diisocyanate which has a functionality of about 2.3. Other isocyanate curing agents having a functionality of 2.0 can be used, including methylene diphenyl diisocyanate (MDI), hydrogenated methylene diphenyl diisocyanate, (hydrogenated MDI), hexamethylene diisocyanate (HMDI), dimeryl diisocyanate (DDI), and isophorone diisocyanate (IPDI). The amount of curing agent employed is about 8 to about 15% by weight of the elastomeric binder.

Where curing agents having a functionality of 2.0 are employed, such as the diisocyanates noted above, additional cross linking can be provided by inclusion of a trifunctional polyol such as trimethylol propane.

A uniform distribution of hexamethylenetetramine and low viscosity liquid hydroxyl terminated prepolymer is achieved, and the prepolymer is cross linked via addition of a liquid curing agent as defined above, which reacts sufficiently slowly that the composition can be poured or cast into a mold prior to setting up. The curing process can be conducted without requiring any heat, but can be accelerated by mild heating. The cure temperature can range from about 20° C. (room temperature) to about 50° C.

If desired, processing aids and/or mechanical property modifiers can be added to the formulation in minor amounts. Thus, a small amount of a "bonding agent" can be added to coat the surface of the hexamethylenetetramine prior to addition of the isocyanate curative to improve processing and/or the mechanical properties of the solid fuel product. Amounts of such agents are typically 0.01 to 0.30% by weight of the total weight of the fuel. A typical agent is a liquid organic amine containing hydroxyl and nitrile functionality.

Another optional component of the improved fuel of the invention is a plasticizer. Typical plasticizers are aliphatic diacid esters such as dioctyl adipate or aromatic diacid esters such as dioctyl phthalate, usually added at levels of from 1.0 to 6.0% of the total weight of the fuel, prior to addition of isocyanate curing agent to improve processing and/or low temperature mechanical properties.

Another option component of the improved fuel of the invention is a low molecular weight acetylenic diol such as 2,4,7,9-tetramethyl-5-decyne-4,7-diol in the elastomeric binder system. Such an ingredient is added in a small amount prior to addition of isocyanate and aids in tailoring mechanical properties and in increasing the available energy output. Amounts of such component employed are generally 0.17 to 6.0% of the total weight of the fuel.

The rocket fuels of the invention react smoothly with oxygen subsequent to ignition. They react directly with other fluid oxidizers such as oxygen, hydrogen peroxide, and oxides of nitrogen such as dinitrogen tetroxide, dinitrogen pentoxide and nitric acid.

The following are examples of the production of hybrid rocket fuels according to the invention:

EXAMPLE 1

About 226 grams of liquid polymeric hydroxyl terminated polybutadiene (HTPB) of molecular weight about 2800 and functionality of 2.5 is placed in a mixing bowl. To the liquid is added 375 grams of hexamethylenetetramine. This is mixed until the liquid is uniformly distributed over the surface of the hexamethylenetetramine. The mixture is degassed under vacuum to remove dissolved water. To the mixture is added 24 grams of polymethylene polyphenyl isocyanate curative with functionality of 2.7. This is mixed until the curative is uniformly distributed and poured into a mold. The mold composition is cured overnight at ambient temperature. The resulting fuel contains 60% by weight hexamethylenetetramine and has a density of 1.11 g/cc. The solid fuel product has good mechanical properties with good heat resistance and very good cold resistance.

The solid fuel reacts readily with oxygen after ignition, combusts smoothly, and exhibits a regression rate of 0.06 in/sec at a mass flux of 0,128 lbm/(sec in$^2$).

EXAMPLE 2

212.5 grams of liquid hydroxyl terminated polybutadiene (HTPB) prepolymer of molecular weight about 2800 and functionality about 2.5 is weighed into a mixing bowl. To the liquid is added 375 grams of hexamethylenetetramine. This is mixed until the liquid is uniformly distributed over the surface of the hexamethylenetetramine. The mixture is degassed under vacuum to remove dissolved water. To the mixture is added oligomeric hexamethylene diisocyanate curative with a functionality of about 2.3 weighing 37.5 grams. This is mixed until the curative is uniformly distributed and poured into a mold. The mold composition is cured overnight at 49° C. The resulting fuel contains 60% by weight hexamethylenetetramine and has a density of about 1.10 g/cc. The solid fuel product has good mechanical properties with good heat resistance and very good cold resistance.

The solid fuel reacts readily with oxygen after ignition, combusts smoothly, and exhibits a regression rate of 0.06 in/sec at a mass flux of 0,128 lbm/(sec in$^2$).

EXAMPLE 3

108,725 grams of a hydroxyl terminated polyether with molecular weight of 3900 and functionality of about 2 was weighed into a mixing bowl with 97.85 grams of a hydroxyl terminated polyether with molecular weight of 4900 and functionality of about 3 plus 10.875 grams of a third hydroxyl terminated polyether with molecular weight of 250 and functionality of about 3. To the mixture of liquids is added 1000 grams of hexamethylenetetramine. This is mixed until the liquid is uniformly distributed over the surface of the hexamethylenetetramine. The mixture is degassed under vacuum to remove dissolved moisture. To the mixture is added 32.55 grams of polymethylene polyphenyl isocyanate with molecular weight of 340 and functionality of 2.7. This is mixed until the curative is uniformly distributed and is then cast into a mold. The mold composition is cured at ambient temperature overnight. The resulting fuel contains 80% by weight hexamethylenetetramine and has a density of about 1.23 g/cc. The solid fuel has good mechanical properties with good heat resistance and very good cold resistance.

The solid fuel reacts readily with oxygen after ignition, combusts smoothly, and exhibits a regression rate of 0.07 in/sec at a mass flux of 0.128 lbm/(sec in$^2$).

It has been found that the regression rate for the rocket fuel of the invention is substantially higher than for other polybutadiene binder fuels filled with other hydrocarbons or containing amounts of hexamethylenetetramine of 50% by weight or less. For instance, the regression rate of a fuel containing 60% hexamethylenetetramine according to the invention is roughly 10% greater than that of the highest regression rate enabled by the Ratz fuel (formulated with 50% hexamethylenetetramine), and the regression rate of a fuel containing 70% or 83% hexamethylenetetramine of the invention is roughly 20% or 30% greater, respectively, than the Ratz 50% hexamethylenetetramine formulation.

The maximum specific impulse of the propulsion system when the fuel of this invention is combined with oxygen is comparable to that of other hybrid fuels, but the amount of oxygen required to achieve the maximum specific impulse is significantly reduced, on the order of about 26% based on the required ratio of oxygen to fuel. The rocket fuel of the invention exhibits smoother combustion than hydrocarbon based hybrid fuels. That is, pressure oscillations are fewer in number and lower in amplitude. The invention fuel also burns at a lower temperature than alternative all hydrocarbon fuels or fuels containing lower amounts of hexamethylenetetramine and produces less water as a combustion product—both of which are beneficial in reducing nozzle throat erosion in graphite based nozzle throat inserts (the industry standard) during motor operation.

Safety and reliability are also improved using the fuel of the invention. Due to separation of oxidizer and fuel., due to ambient temperature processing, and due to the fact that this fuel is non-volatile and consequently relatively difficult to ignite, all aspects of fuel and rocket motor processing and handling from raw materials storage and handling, through manufacturing, motor storage, and motor handling are safer, and motor operation is more reliable than corresponding operations involving propulsion systems based on either all solids or all liquids.

The solid fuel of the invention has good mechanical properties, good heat resistance and very good cold resistance. It exhibits excellent aging properties, being resistant to degradation of mechanical properties due to interaction with moisture in air.

From the foregoing, it is seen that the invention provides an improved hybrid rocket fuel which contains a major proportion of hexamethylenetetramine as the fuel in conjunction with a hydroxyl terminated prepolymer binder cured by an isocyanate cross-linking agent. The resultant inert fuel grain can be placed in a rocket motor equipped with a nozzle and oxygen inlets, ignited with a squib or pyrophoric gas, and will burn as long as oxygen or air is continuously introduced. It can be extinguished when the oxygen flow is halted and the exothermic combustion reaction stops. The solid fuel of the invention also has potential use in ramjets, automotive air bags, or other systems requiring a safe, compact, easily stored fuel capable of being converted to a propulsive gas in a short time.

Since various changes and modifications of the invention will occur to those skilled in the art within the spirit of the invention, the invention is not to be taken as limited except by the scope of the appended claims.

What is claimed is:

1. A fuel substance for hybrid rocket propulsion consisting essentially of hexamethylenetetramine and an elastomeric binder system, said hexamethylenetetramine being present in an amount of about 60 to about 83% based on the total weight of the fuel.

2. The fuel substance of claim 1, wherein said elastomeric binder system is selected from the group consisting of liquid prepolymers of hydroxyl terminated polybutadiene, hydroxyl terminated polyether and hydroxyl terminated polyester, cured by an isocyanate cross-linking agent.

3. The fuel substance of claim 2, wherein said isocyanate is a multifunctional isocyanate.

4. The fuel substance of claim 2, wherein said isocyanate is a member selected from the group consisting of oligomeric hexamethylene diisocyanate and polymethylene polyphenyl isocyanate.

5. The fuel substance of claim 2, wherein said isocyanate is a member selected from the group consisting of dimeryl diisocyanate, isophorone diisocyanate, methylene diphenyl diisocyanate, hydrogenated methylene diphenyl diisocyanate, and hexamethylene diisocyanate.

6. The fuel substance of claim 5, and including a trifunctional polyol to provide additional cross linking.

7. The fuel substance of claim 1, wherein said elastomeric binder system comprises a liquid prepolymer of hydroxyl terminal polybutadiene cured by an isocyanate cross-linking agent.

8. The fuel substance of claim 1, wherein said elastomeric binder system comprises a liquid prepolymer of hydroxyl terminated polyether cured by an isocyanate cross-linking agent.

9. The fuel substance of claim 8, wherein said elastomeric binder system comprises a combination of liquid hydroxyl terminated polyethers ranging in molecular weight from about 250 to about 7300, and ranging in functionality from 2 to 4.

10. The fuel substance of claim 1, wherein said elastomeric binder system comprises a liquid prepolymer of hydroxyl terminated polyester cured by an isocyanate cross-linking agent.

11. The fuel substance of claim 10, wherein said elastomeric binder system comprises a combination of liquid hydroxyl terminated polyesters ranging in molecular weight from about 750 to about 4000 with functionality of 2.

12. The fuel substance of claim 1, including a plasticizer in an amount of 1.0 to 6.0% by weight of the total formulation in said binder system.

13. The fuel substance of claim 1, including 0.01 to 0.30% by total weight of fuel of a bonding agent in said binder system.

14. The fuel substance of claim 7, said binder system cured by polymethylene polyphenyl isocyanate.

15. The fuel substance of claim 14, wherein said hydroxyl terminated polybutadiene has a molecular weight of about 2800, functionality about 2.5, and said polymethylene polyphenyl isocyanate has a molecular weight ranging from 290 to 375, functionality of about 2.3 to 3.0.

16. The fuel substance of claim 8, wherein said binder system comprises a mixture of at least three prepolymers in which said first prepolymer has a molecular weight of 3900 and functionality of 2, said second prepolymer has a molecular weight of 4900 and a functionality of 3, and said third prepolymer has a molecular weight of 250 and a functionality of 3, and including polymethylene polyphenyl isocyanate as a curing agent having a molecular weight of about 340, and functionality of about 2.5 to 2.7.

17. The fuel substance of claim 1, said hexamethylenetetramine being present in an amount of about 70 to about 83% based on the total weight of the fuel.

18. A fuel substance for hybrid rocket propulsion comprising hexamethylenetetramine and an elastomeric binder system, said hexamethylenetetramine being present in an amount of about 60% to about 83% based on the total weight of the fuel.

19. The fuel substance of claim 18, wherein said elastomeric binder system is selected from the group consisting of liquid prepolymers of hydroxyl terminated polybutadiene, hydroxyl terminated polyether, and hydroxyl terminated polyester, cured by an isocyanate cross-linking agent.

20. The fuel substance of claim 19, wherein said isocyanate is a multi-functional isocyanate.

21. The fuel substance of claim 19, wherein said isocyanate is a member selected from the group consisting of oligomeric hexamethylene diisocyanate and polymethylene polyphenyl isocyanate.

22. The fuel substance of claim 19, wherein said isocyanate is a member selected from the group consisting of dimeryl diisocyanate, hydrogenated methylene diphenyl diisocyanate, and hexamethylene diisocyanate.

23. The fuel substance of claim 22, and further comprising tri-functional polyol to provide additional cross-linking.

24. The fuel substance of claim 18, wherein said elastomeric binder system comprises a liquid prepolymer of hydroxyl terminated polybutadiene cured by an isocyanate.

25. The fuel substance of claim 18, wherein said elastomeric binder system comprises a liquid prepolymer of hydroxyl terminated polyether cured by an isocyanate cross-linking agent.

26. The substance of claim 25, wherein said elastomeric binder system comprises a combination of liquid hydroxyl terminated polyethers ranging in molecular weight from about 250 to about 7300, and ranging in functionality from 2 to 4.

27. The fuel substance of claim 18, wherein said elastomeric binder system comprises a liquid prepolymer of hydroxyl terminated polyester cured by an isocyanate cross-linking agent.

28. The fuel substance of claim 27, wherein said elastomeric binder system comprises a combination of liquid hydroxyl terminated polyesters ranging in molecular weight from about 750 to about 4000 with functionality of 2.

29. The fuel substance of claim 28 further comprises a plasticizer in an amount of 1.0 to 6.0 by weight of the total formulation in said binder system.

30. The fuel substance of claim 18 further comprising 0.01 to 0.30% by total weight of fuel of a bonding agent in said binder system.

31. The fuel substance of claim 24, wherein said binder system is cured by polymethylene polyphenyl isocyanate.

32. The fuel substance of claim 31, wherein said hydroxyl terminated polybutadiene has a molecular weight of about 2800 and functionality about 2.5, and said polymethylene polyphenyl isocyanate has a molecular weight ranging from 290 to 375 and functionality of about 2.3 to 3.0.

33. The fuel substance of claim 25, wherein said binder system comprises a mixture of at least three prepolymers in which said first prepolymer has a molecular weight of 3900 and functionality of 2, said second prepolymer has a molecular weight of 4900 and a functionality of 3, and said third hydroxyl terminated polyether has a molecular weight of 250 and a functionality of 3, and including polymethylene polyphenyl isocyanate as a curing agent having a molecular weight of about 340 and functionality of about 2.5 to 2.7.

34. The fuel substance of claim 18, said hexamethylenetetramine being present in an amount of about 70% to about 83% based on the total weight of the fuel.

* * * * *